US007004361B2

(12) United States Patent
Thomas

(10) Patent No.: US 7,004,361 B2
(45) Date of Patent: Feb. 28, 2006

(54) COLLAR-SHAPING DEVICE

(76) Inventor: Daniel Thomas, RR #4, Acton, On (CA), L7J 2M1

( * ) Notice: Subject to any disclaimer, the term of this patent is extended or adjusted under 35 U.S.C. 154(b) by 99 days.

(21) Appl. No.: 10/458,894

(22) Filed: Jun. 11, 2003

(65) Prior Publication Data

US 2004/0016778 A1 Jan. 29, 2004

Related U.S. Application Data

(60) Provisional application No. 60/398,977, filed on Jul. 26, 2002.

(51) Int. Cl.
*A41H 33/00* (2006.01)

(52) U.S. Cl. ..... 223/3

(58) Field of Classification Search ..... 223/2, 223/3, 4; 2/132, 256, 260.1
See application file for complete search history.

(56) References Cited

U.S. PATENT DOCUMENTS

| | | | | |
|---|---|---|---|---|
| 1,105,407 A | | 7/1914 | Curtis | |
| 1,606,920 A | | 11/1926 | Bornstein | |
| 2,110,525 A | | 3/1938 | Kass | |
| 2,487,284 A | | 11/1949 | Thomas | |
| 2,510,030 A | * | 5/1950 | Carlisle, Jr. | 2/132 |
| 2,769,979 A | | 11/1956 | Driesbach | |
| 2,964,756 A | | 12/1960 | Liebowitz | |
| 3,286,278 A | | 11/1966 | O'Connor | |
| 3,860,967 A | | 1/1975 | Tedesco | |
| 4,000,522 A | | 1/1977 | Swanson | |
| 4,038,840 A | | 8/1977 | Castello | |
| 4,202,054 A | | 5/1980 | Siragusa | |
| 4,286,337 A | | 9/1981 | Malouf, Jr. | |
| 4,434,512 A | | 3/1984 | Hansen | |
| 4,553,291 A | | 11/1985 | Carey | |
| 4,628,545 A | | 12/1986 | Metzler | |
| 4,939,794 A | | 7/1990 | Aronson | |
| 4,975,983 A | | 12/1990 | Everett | |
| 5,626,267 A | * | 5/1997 | Peruski | 223/84 |
| 5,761,744 A | | 6/1998 | Horvat et al. | |
| 5,769,288 A | | 6/1998 | Berglund | |
| 5,956,769 A | | 9/1999 | Stepney | |
| 6,012,573 A | | 1/2000 | Kurimoto | |
| 6,112,329 A | | 9/2000 | Freiherr von Korff | |
| 6,161,224 A | | 12/2000 | Tuetken | |
| 6,167,732 B1 | | 1/2001 | Friedman | |

(Continued)

FOREIGN PATENT DOCUMENTS

| | | |
|---|---|---|
| EP | 1138217 A1 | 3/2002 |
| FR | 2800576 A1 | 8/1999 |
| GB | 694652 | 9/1950 |

OTHER PUBLICATIONS

CollarSTYX, pages entitled "adcopy1" and "consumer.htm" from website "www.collarstyx.com", dated Dec. 5, 2004.

*Primary Examiner*—Rodney M. Lindsey
*Assistant Examiner*—James G Smith
(74) *Attorney, Agent, or Firm*—Clark Hill PLC

(57) ABSTRACT

An apparatus for use in shaping casual turn-down collars has a flexible sheet substrate with a profile that fits underneath a casual turn-down collar. There is an adhesive coating on each side of the substrate. The substrate fits without showing and with a portion of the substrate near a tip of the collar. The coating is self-releasing and pressure sensitive. There is a cover film on each side of the substrate over the adhesive coating. The substrate has a removal tab section with no adhesive coating on each side of the substrate. There is a pull-tab on each cover film that extends beyond the adhesive coating on the substrate. The pull-tab extends over the removal tab section. The collar is manually shaped and the apparatus is placed between the shirt body and the collar to fix the collar in place.

9 Claims, 2 Drawing Sheets

U.S. PATENT DOCUMENTS 6,212,686 B1 4/2001 Krause et al.
6,240,559 B1 6/2001 Cares
6,247,207 B1 6/2001 Nitsche
6,248,418 B1 6/2001 Taguchi et al.
6,250,116 B1 6/2001 Groshens
6,263,510 B1 7/2001 Bay et al.
6,269,988 B1 8/2001 Kool
6,276,576 B1 8/2001 Thomas
6,367,088 B1 4/2002 Bergemann

* cited by examiner

COLLAR-SHAPING DEVICE

CROSS-REFERENCE TO RELATED APPLICATIONS

This application claims the benefit of the filing date of U.S. provisional application Ser. No. 60/398,977 filed Jul. 26, 2002 under title Collar-shaping Device listing Daniel Thomas as inventor.

FIELD OF THE INVENTION

The invention relates to devices and methods of fastening turn-down shirt collars.

BACKGROUND OF THE INVENTION

Casual turned-down shirt collars are meant to look relaxed. The collars have a weave that is not as tight as a dress turned-down shirt collar. Casual shirt collars do not have stiffeners, such as stays. A shirt with a casual turned-down collar is sometimes known as a golf shirt, or a sport shirt.

Although causal shirt collars are meant to look relaxed, they are not supposed to be untidy. Unfortunately, after being worn and washed a few times the shirt collar tends to curl away from the body of the shirt and the collar tends to lose its shape.

This problem can also be encountered in dress shirts. Numerous solutions have been used, including collar stays (built-in or removable), buttons, snaps and ironing/starch. None of these solutions is particularly well adapted to the relaxed weave, look and fit of a casual shirt.

The invention is meant to address these and other issues with casual turned-down shirt collars.

SUMMARY OF THE INVENTION

In a first aspect of the invention provides an apparatus for use in shaping casual turn-down collars has a flexible sheet substrate with a profile that fits underneath a casual turn-down collar. There is an adhesive coating on each side of the substrate. The substrate may fit without showing and with a portion of the substrate near a tip of the collar. The coating may be self-releasing and pressure sensitive. There may be a cover film on each side of the substrate over the adhesive coating. The substrate may have a removal tab section with no adhesive coating on each side of the substrate. There may be a pull-tab on each cover film that extends beyond the adhesive coating on the substrate. The pull-tab may extend over the removal tab section.

The substrate may have an acute angled L-shaped profile that fits underneath a casual turn-down collar without showing and with a portion of the substrate near a tip of the collar. Alternatively, the substrate may have a bow-tie profile that fits underneath a casual turn-down collar without showing and with a portion of the substrate near a tip of the collar.

In a second aspect the invention provides a method of shaping a casual turn-down collar of a shirt having a shirt body, wherein the collar is manually shaped and the apparatus described above is placed between the shirt body and the collar to fix the collar in place.

Other aspect will be evident to those skilled in the art based on the following detailed description.

BRIEF DESCRIPTION OF THE DRAWINGS

For a better understanding of the present invention and to show more were clearly how it may be carried into effect, reference will now be made, by way of example, to the accompanying drawings that show the preferred embodiment of the present invention and in which.

DETAILED DESCRIPTION OF THE PREFERRED EMBODIMENT

Figure 1:
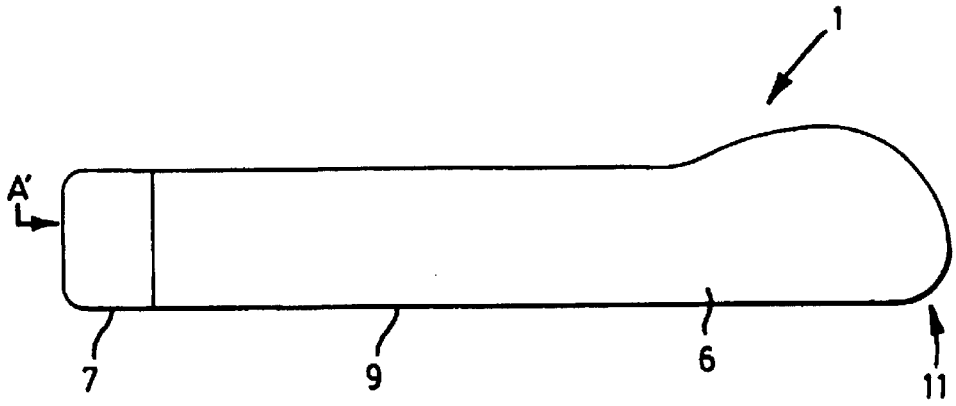
FIG. 1 is a front view of a collar-shaping device according to a preferred embodiment of the invention.
Figure 2:
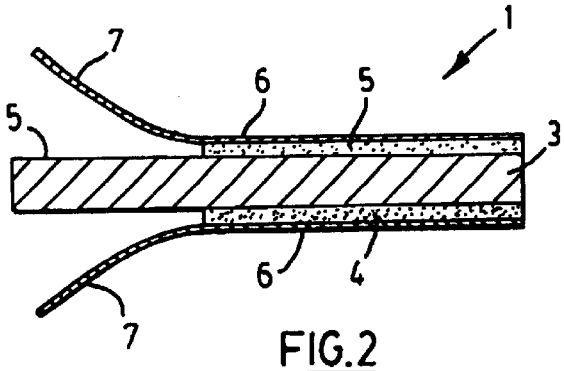
FIG. 2 is a not-to-scale cross-section through the line A–A' of FIG. 1.

Referring to FIGS. 1 and 2, a collar-shaping device 1 is composed of a substrate 3 of PVC clear sheet to which is applied a coating 4 on both sides of a self-releasing pressure sensitive adhesive. The substrate 3 should be sufficiently flexible to form to the shape of a casual shirt (see for example shirt 21, FIG. 4). Both sides of the shaping device 1 are laminated with clear plastic film 6 that will peel away exposing the pre mentioned coating 4. Both of the peel away films 6 have pull-tabs 7 to allow fast removal. The adhesive coating 4 does not extend along a removal tab section 4 of the substrate 3 where pull-tabs 7 are located so tabs 7 are easy to pull off. The substrate has a long narrow strip portion 9 with a rounded expanded end 11.

The collar-shaping device 1 can have a variety of shapes. The device 1 must have a profile that fits underneath a turn-down collar (see for example collar 22, FIG. 4) without showing when placed sufficiently close to the collar tip (see for example tip 20, FIG. 4) to hold down the collar tip. Sample dimensions are a length of 1⅝" for the substrate 3, a height of ¼" for the strip portion 9 and a peak height of ⅜" for the expanded portion 11.

Figure 3:
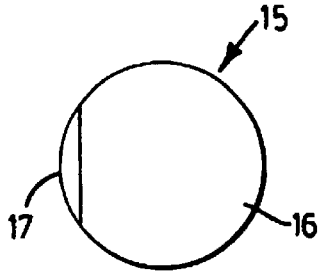
FIG. 3 is a front view of a collar-shaping device according to an alternate embodiment of the invention.

Referring to FIG. 3, a collar-shaping device 15 is similar to the collar-shaping device 1. The collar-shaping device 15 has a similar cross-section to the collar-shaping device 1, with a substrate, coating, and film 16 with tabs 17. Sample dimensions for device 15 are ½" in diameter.

Figure 4:
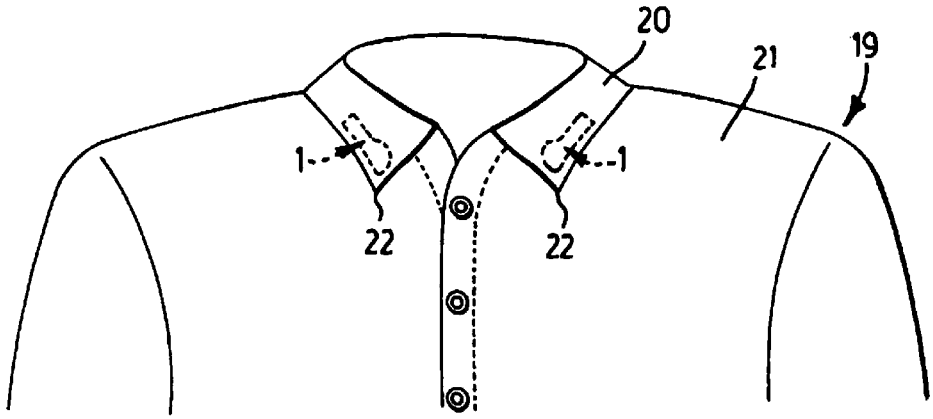
FIG. 4 is a perspective view of a casual turn-down collar shirt with the collar-shaping device of FIG. 1 installed.

Referring to FIG. 4, the collar-shaping device 1 is removed from a package, not shown. The film 6 is removed from both sides of the substrate 3 by pulling the tabs 7 to expose coating 4. The substrate 3 is then placed on shirt 19 on the under surface of the turned-down portion of collar 20 of shirt 19 near tip 22. The collar 20 is then manually shaped into desired position. Once collar 20 is in position, pressure is applied to secure the collar 20 to shirt body 21 in aesthetically proper position. Alternatively, the device 1 could be placed on the shirt body 21 and the collar 20 secured to it; however, alignment of the device 1 with the collar 20 may be more difficult using this approach.

The expanded portion 11 of the substrate 3 provides extra adhesion at tip 22 of collar 20.

The device 15 is similarly applied near the tip 22 of collar 20.

No sewing is needed, no special tools are needed, and no ironing is applicable.

The devices 1, 15 are easily removed by pulling on the removal tab section 4.

Although the devices 1, 15 have been described as clear, the devices 1, 15 may be coloured, for example with a colour that matches the collar 20.

The coating 4 is self-releasing in that it allows removal of the film 6 from the substrate and it remains on the substrate 3 when the film 6 is removed. The coating 4 should also remain on the substrate 3 when the substrate 3 is removed from the shirt 21. Also, and possibly alternatively, the coating 4 should be soluble in the conditions used to launder the shirt 21, typically water and some form of detergent.

Figure 5:
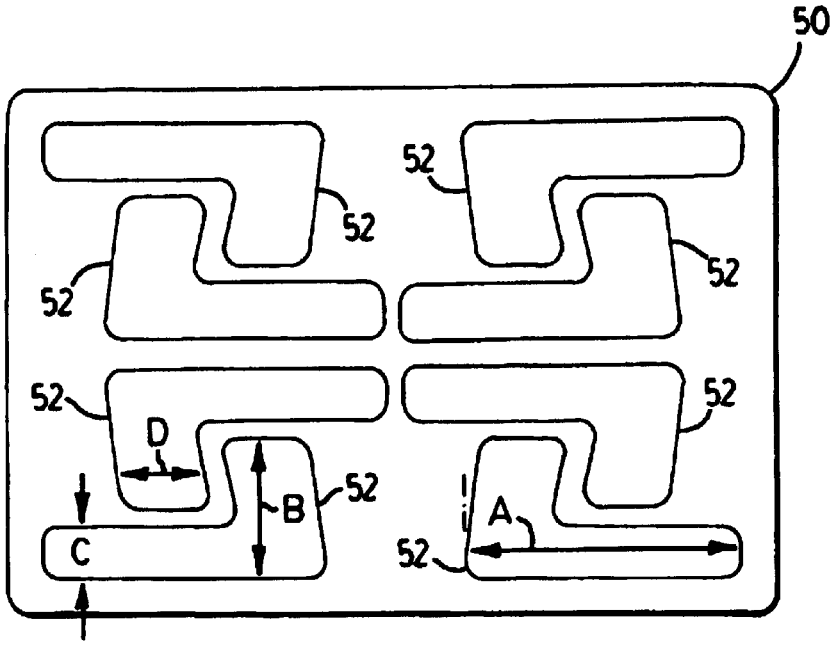
FIG. 5 is a front view of a sheet of collar-shaping devices according to a preferred embodiment of the invention.

Referring to FIG. 5, a sheet 50 has eight collar shaping devices 52 in an acute angled 54 L-shape configuration. The sheet 50 is similar to the devices 1 and 15 in having a substrate 3 with a coating 4 and film 6 on either side of the substrate. Only one of the films 6 is indicated in FIG. 5 as it is a front view. The devices 52 are angled 54 such that when in use the device substrate 3 will fit the profile of many casual turn-down collars. It has been found that the extended L-shape configuration provides better adhesion and holds the collar in a more stable look than the devices 1 and 15.

In the preferred embodiment of FIG. 5 the dimension A is 1 inch, B is 0.5 inch, C is 0.1875 inch, D is 0.3125 inch, while the corner radii are 0.0625 inch. Different dimensions can be used to fit collars of different dimensions. Dimensions similar to those of the preferred embodiment are to be used only as a rough guide for the types of shirts that are generally available.

The sheet 50 is pre-cut about the devices 52 through a first layer of film 6 and the substrate 3. The substrate 3 and the first layer of film 6 are peeled away from the second layer of film 6 when it is desired to use a device 52. The sheet 50 can have different quantities of devices 52, as desired. The devices and 15 can be similarly provided in a pre-cut sheet configuration. Alternatively, the devices 52 can be provided as single devices 52.

Figure 6:
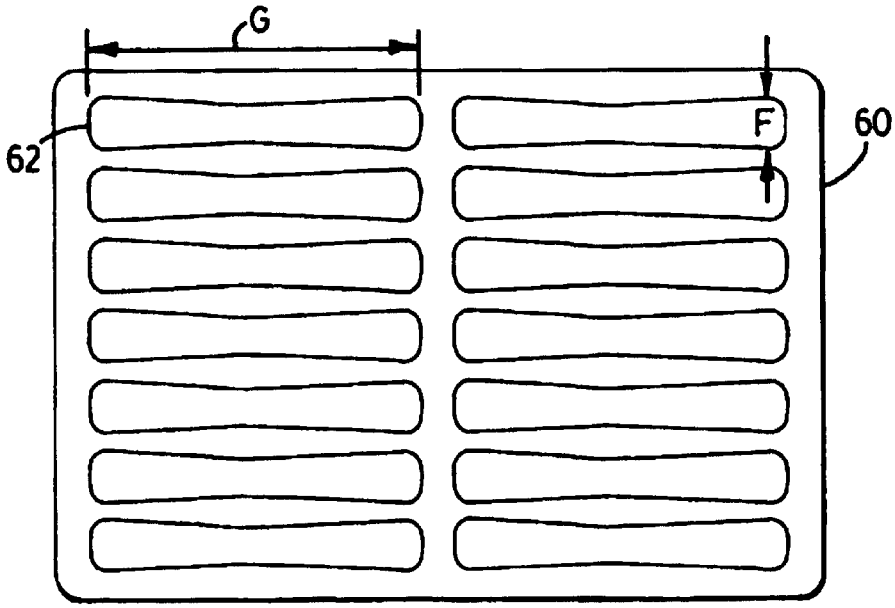
FIG. 6 is a front view of a sheet of collar-shaping devices according to an alternative embodiment of the invention.

Referring to FIG. 6, a sheet 60 has fourteen general purpose collar-shaping devices 62. The devices 62 are again similar to the devices 1, 15 and 52 in having a substrate 3 with a coating 4 and film 6 on either side of the substrate 3. The devices 62 have a bow-tie configuration as the devices 62 are each bounded by two opposing parallel edges 64 and two tapered edges 66 extending between the parallel edges 64. The tapered edges 66 slope toward one another as they extend away from the parallel edges 64, while the tapered edges do not touch one another. The taper has been found to provide better adhesion qualities In the preferred embodiment of FIG. 6 the dimension F is 0.1875 inch and G is 1.1875 inch, while the corner radii are 0.0625 inch. Different dimensions can be used to fit collars of different dimensions. Dimensions similar to those of the preferred embodiment are to be used only as a rough guide for the types of shirts that are generally available.

The sheet 60 is pre-cut in the same manner as sheet 50. The devices 62 can also be provided as single devices 62, or in sheets of different quantities of devices 62.

It will be understood by those skilled in the art that this description is made with reference to the preferred embodiment and that it is possible to make other embodiments employing the principles of the invention which fall within its spirit and scope as defined by the following claims.

We claim:

1. An apparatus for use in shaping casual turn-down collars with a collar tip, the collars on a shirt that has a shirt body, the apparatus comprising:

a) a flexible sheet substrate, and b) an adhesive coating on each side of the substrate, one side of the substrate for securing to the casual turn-down collar, and another side of the substrate for securing to the shirt body.

wherein the substrate has an acute-angled profile that fits underneath a casual turn-down collar when the acute-angle of the profile is placed sufficiently close to the tip of the collar to secure the tip to the shirt body, and wherein the collar retains its relaxed look.

2. The apparatus of claim 1 wherein the acute angled profile has an extended dimension along an edge of the profile and an expanded dimension perpendicular to the extended dimension, and the extended dimension is greater than the expanded dimension.

3. The apparatus of claim 2 wherein the acute angled profile is generally L-shaped with an extended portion of the L-shape extending for the extended dimension, and an expanded portion of the L-shape extending at the acute angle to the extended portion for the expanded dimension.

4. The apparatus of claim 3, wherein the expanded dimension is approximately one-half inch.

5. The apparatus of claim 4, wherein the acute angle is approximately 85 degrees.

6.The apparatus of claim 5, wherein the extended dimension is approximately one inch.

7. The apparatus of claim 6, wherein the expanded portion extends approximately three-eighths of an inch in the extended dimension.

8. The apparatus of claim 7, wherein the extended portion extends approximately one-eighth of an inch in the expanded dimension.

9. A method of shaping a casual turn-down shirt collar of a shirt that has a shirt body, the method comprising the steps of:

a) adhering the apparatus of claim 1 between the collar and the shirt body to fix the collar in place with the acute angle of the profile placed sufficiently close to the tip of the collar to secure the tip to the shirt body, and with one edge of the profile generally aligned parallel to a bottom edge of the collar.

* * * * *